US011691249B2

(12) United States Patent
Ross et al.

(10) Patent No.: US 11,691,249 B2
(45) Date of Patent: Jul. 4, 2023

(54) PUSH BUTTON RELEASE MECHANISM FOR PLIERS

(71) Applicant: Snap-on Incorporated, Kenosha, WI (US)

(72) Inventors: David T. Ross, Kenosha, WI (US); David T. Doyle, Kenosha, WI (US); Richard L. Hopper, Kenosha, WI (US)

(73) Assignee: Snap-on Incorporated

( * ) Notice: Subject to any disclaimer, the term of this patent is extended or adjusted under 35 U.S.C. 154(b) by 306 days.

(21) Appl. No.: 16/942,304

(22) Filed: Jul. 29, 2020

(65) Prior Publication Data

US 2022/0032426 A1 Feb. 3, 2022

(51) Int. Cl.
*B25B 7/10* (2006.01)
*B25B 27/20* (2006.01)

(52) U.S. Cl.
CPC ..... *B25B 7/10* (2013.01); *B25B 27/205* (2013.01)

(58) Field of Classification Search
CPC .... B25B 7/00; B25B 7/02; B25B 7/06; B25B 7/08; B25B 7/10; B25B 7/14; B25B 27/205; B25B 23/007
See application file for complete search history.

(56) References Cited

U.S. PATENT DOCUMENTS 1,231,167 A 6/1917 Jones
1,401,931 A 12/1921 Whelan
1,410,866 A 3/1922 Young
1,867,912 A 7/1932 George
2,395,988 A 3/1946 Biles
2,483,380 A 9/1949 Duffy
2,724,300 A 11/1955 Ohman
2,968,205 A 1/1961 Springate
3,662,449 A 5/1972 Hashimoto
(Continued)

FOREIGN PATENT DOCUMENTS

AU 2013211520 A1 2/2014
CN 201002220 Y 1/2008
(Continued)

OTHER PUBLICATIONS

United Kingdom Combined Search and Examination Report for corresponding UK Application No. GB2109339.8, dated Apr. 25, 2022, 10 pages.
(Continued)

*Primary Examiner* — Robert J Scruggs
(74) *Attorney, Agent, or Firm* — Seyfarth Shaw LLP

(57) ABSTRACT

A push button release mechanism for coupling together two portions of a tool, such as pliers. The push button release mechanism can include a push button and one or more balls pushed in a radially-outward direction by geometry of the push button to pivotally couple the two portions together. The balls are normally pushed outward by an engagement portion. Depressing a push button head axially downward causes the balls to align with a receiving portion, which allows the balls to descend into the interior of the mechanism. The push button release mechanism is also threadably coupled with a threaded opening of one of the portions. The threaded opening can have deformed threads to increase the retention torque required to rotate the push button release mechanism.

18 Claims, 5 Drawing Sheets

(56) References Cited

U.S. PATENT DOCUMENTS

| | | | | |
|---|---|---|---|---|
| 3,713,356 | A | 1/1973 | Knudsen | |
| 3,762,019 | A | 10/1973 | Epstein | |
| 4,296,655 | A | 10/1981 | Tesoro | |
| 4,581,960 | A | 4/1986 | Putsch et al. | |
| 4,773,288 | A * | 9/1988 | Jang | B25B 7/10 81/409.5 |
| 4,793,224 | A | 12/1988 | Huang | |
| 4,893,530 | A | 1/1990 | Warheit | |
| 4,903,558 | A | 2/1990 | Le Duc | |
| 4,907,477 | A | 3/1990 | Farber | |
| 4,947,553 | A | 8/1990 | Bendickson et al. | |
| 5,007,313 | A | 4/1991 | Jeromson, Jr. et al. | |
| 5,386,747 | A | 2/1995 | Grover | |
| 5,419,221 | A | 5/1995 | Cole | |
| 5,461,951 | A | 10/1995 | Putsch | |
| 5,664,274 | A | 9/1997 | Collins | |
| 5,694,818 | A | 12/1997 | Nickipuck | |
| 5,826,467 | A | 10/1998 | Huang | |
| 5,865,075 | A | 2/1999 | Medved | |
| 6,006,631 | A | 12/1999 | Miner et al. | |
| 6,145,417 | A | 11/2000 | Bates et al. | |
| 6,161,982 | A | 12/2000 | Cole | |
| 6,282,995 | B1 | 9/2001 | Lin | |
| 6,318,217 | B1 | 11/2001 | Emhardt et al. | |
| 6,378,403 | B1 | 4/2002 | Bates et al. | |
| 6,386,789 | B1 | 5/2002 | Chausse et al. | |
| 6,470,774 | B2 | 10/2002 | Chang | |
| 6,792,837 | B2 | 9/2004 | Battistone | |
| 6,880,434 | B2 | 4/2005 | Nouvel | |
| 2,414,705 | A1 | 12/2005 | Yu | |
| 6,976,412 | B1 * | 12/2005 | Yu | B25B 27/205 81/485 |
| 7,055,413 | B1 | 6/2006 | Wang | |
| 7,182,004 | B1 | 2/2007 | Wang | |
| 7,222,558 | B2 | 5/2007 | Lothar et al. | |
| 7,730,810 | B1 | 6/2010 | Janson | |
| 7,891,903 | B2 | 2/2011 | Klingenberg et al. | |
| 3,051,749 | A1 | 11/2011 | Gustafson et al. | |
| 8,266,990 | B1 | 9/2012 | Janson | |
| 8,347,471 | B2 | 1/2013 | Wang | |
| 8,695,464 | B2 | 4/2014 | Herrmann | |
| D775,916 | S | 1/2017 | Ludtke et al. | |
| 10,421,178 | B2 | 9/2019 | Engel et al. | |
| 10,994,390 | B2 | 5/2021 | Dahlke et al. | |
| 2004/0194590 | A1 | 10/2004 | Engvall et al. | |
| 2010/0018364 | A1 | 1/2010 | Chervenak et al. | |
| 2010/0132517 | A1 | 6/2010 | Crawford | |
| 2011/0214538 | A1 | 9/2011 | Huang | |
| 2013/0019720 | A1 | 1/2013 | Harrison et al. | |
| 2013/0025417 | A1 * | 1/2013 | Tsai | B25G 1/063 81/177.8 |
| 2014/0053694 | A1 | 2/2014 | Lin Wu | |
| 2016/0303721 | A1 | 10/2016 | Ludtke et al. | |
| 2018/0079057 | A1 | 3/2018 | Chen | |
| 2018/0147706 | A1 * | 5/2018 | Murg | B25B 27/205 |
| 2019/0232479 | A1 * | 8/2019 | Wiwatowski | B25F 1/02 |
| 2020/0171625 | A1 | 6/2020 | Diederich et al. | |

FOREIGN PATENT DOCUMENTS

| | | | |
|---|---|---|---|
| CN | 201015848 | Y | 2/2008 |
| CN | 101568408 | A | 10/2009 |
| CN | 204195565 | U | 3/2015 |
| CN | 109963518 | A | 7/2019 |
| DE | 102016104621 | A1 | 9/2017 |
| EP | 2329920 | U | 12/2009 |
| GB | 2414705 | | 12/2005 |
| TW | M385448 | U | 8/2010 |
| TW | 202021732 | A | 6/2020 |

OTHER PUBLICATIONS

Australian Examination Report No. 1 for Application No. 2019204075 dated Apr. 9, 2020, 6 pages.

United Kingdom Combined Search and Examination Report for Application No. GB1908298.1, dated Nov. 29, 2019, 7 pages.

https://www.amazon.com/T19170-Arched-Handle-8-Inch-Button/dp/B00A32EAGA.

https://www.mactools.com/products/pk9rrpb?variant=39814992953527 [mactools.com].

https://www.superarbor.io/products/309087405-17-in-swedish-pipe-wrench-with-push-button-adjustment[superarbor.io].

https://www.amazon.com/Bahco-8225-Adjustable-Pliers-12-Inch/dp/B0012KFHE6.

Taiwan Office Action for corresponding Application No. 11120991690 dated Oct. 11, 2022, 9 pages.

Canadian Office Action for corresponding Application No. 3,123,989 dated Oct. 31, 2022, 3 pages.

Examination Report for corresponding Application No. GB2109339.8 dated Nov. 15, 2022, 4 pages.

Taiwan Office Action for corresponding Application No. 11220098490 dated Feb. 4, 2023, 7 pages.

Chinese Office Action for corresponding Application No. 2021108647749 dated Feb. 15, 2023, 10 pages.

* cited by examiner

PUSH BUTTON RELEASE MECHANISM FOR PLIERS

TECHNICAL FIELD OF THE INVENTION

The present invention relates generally to push button release mechanisms that removably couple two halves of pliers.

BACKGROUND OF THE INVENTION

Pliers are a common tool used for gripping work pieces or other objects. Pliers include two portions that rotate about a connecting pin so that a user can hold the two portions at a first end and engage a work piece at a second end. Pliers often have multiple configurations to allow a user to adjust from a narrow-mouthed or wide-mouthed configuration for small or large objects, respectively, such as, for example, internal or external snap rings.

Conventional pliers include pins or slots to provide the adjustability necessary for multiple configurations. For example, a pair of pliers could include multiple openings to allow the user to adjust the jaw width as the user sees fit. A pin could fit into each of the openings, e.g., a first opening for narrow-mouthed applications and a second opening for wide-mouthed applications. The pliers could also include a pin that is fixed about one of the plier halves, but where the other plier half includes a slot that the pin slides within to reach the desired width of the plier jaws. Other mechanisms, such as a toothed engagement, can then removably couple the plier halves in place once the pin and slot are located in the preferred arrangement. Other conventional pliers include a push button pin that couples two halves of a pliers tool together. The push button pin is typically coupled to one of the plier halves via a retaining ring.

SUMMARY OF THE INVENTION

The present invention broadly comprises a push button release mechanism for pliers. The push button release mechanism is adapted to pivotally couple together two pliers' portions in various configurations to adjust the jaw width of the pliers. The push button release mechanism includes external threading adapted to threadably couple to one of the pliers' portions that has internal threading. The push button release mechanism also includes one or more detent balls that are pushed in a radially-outward direction to pivotally couple and retain the two portions together in one of the various configurations at the desired jaw width. The detent balls descend into a receiving portion when a push button head is pushed inwardly to allow the two pliers' portions to be separated. A user can therefore quickly change the respective portions depending on need. The internal threading may be deformed, such as for example, by staking. The threaded interface between the pliers' portion and the push button release mechanism allows the push button release mechanism to be adjusted relative to the pliers' portion in an axial direction to account for tolerance variation. Once the position of the push button release mechanism relative to the pliers' portion is set, deformation of the internal threading with staking maintains the position.

In particular, the present invention broadly comprises a tool including first and second portions selectively and rotatably coupled together by a push button release mechanism. The first portion includes a first opening adapted to axially receive the push button release mechanism, and the second portion includes a threaded opening adapted to threadably couple to the push button release mechanism. Therefore, the push button release is coupled to the second portion, and the first portion is rotatable about the push button release, whereby the first and second portions are pivotally coupled together. The push button release mechanism includes a push button axially movable between first and second positions and a receiving portion having a receiving portion outer diameter and an engagement portion having an engagement portion outer diameter and extending axially from the receiving portion, a sleeve defining a cavity within which the push button moves axially, the sleeve including external threads and a ball opening, a ball disposed within the ball opening, and a biasing member adapted to bias the push button axially outward from the cavity to the first position and substantially align the engagement portion with the ball when axial force is not applied to the push button. When axial force is applied to the push button, the push button is adapted to be disposed in the second position to align the receiving portion with the ball.

The present invention also broadly comprises a push button release mechanism adapted to selectively and rotatably couple first and second portions of a tool. The push button release mechanism including a push button axially movable between first and second positions and including a receiving portion having a receiving portion outer diameter and an engagement portion having an engagement portion outer diameter and extending axially from the receiving portion, a sleeve defining a cavity within which the push button moves axially, the sleeve including a ball opening and external threads adapted to threadably couple to a threaded opening disposed in the second portion, a ball disposed within the ball opening, and a biasing member adapted to bias the push button axially outward from the cavity to the first position and substantially align the engagement portion with the ball when axial force is not applied to the push button. When axial force is applied to the push button, the push button is adapted to be disposed in the second position to align the receiving portion with the ball

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION OF THE EMBODIMENTS

Figure 1:
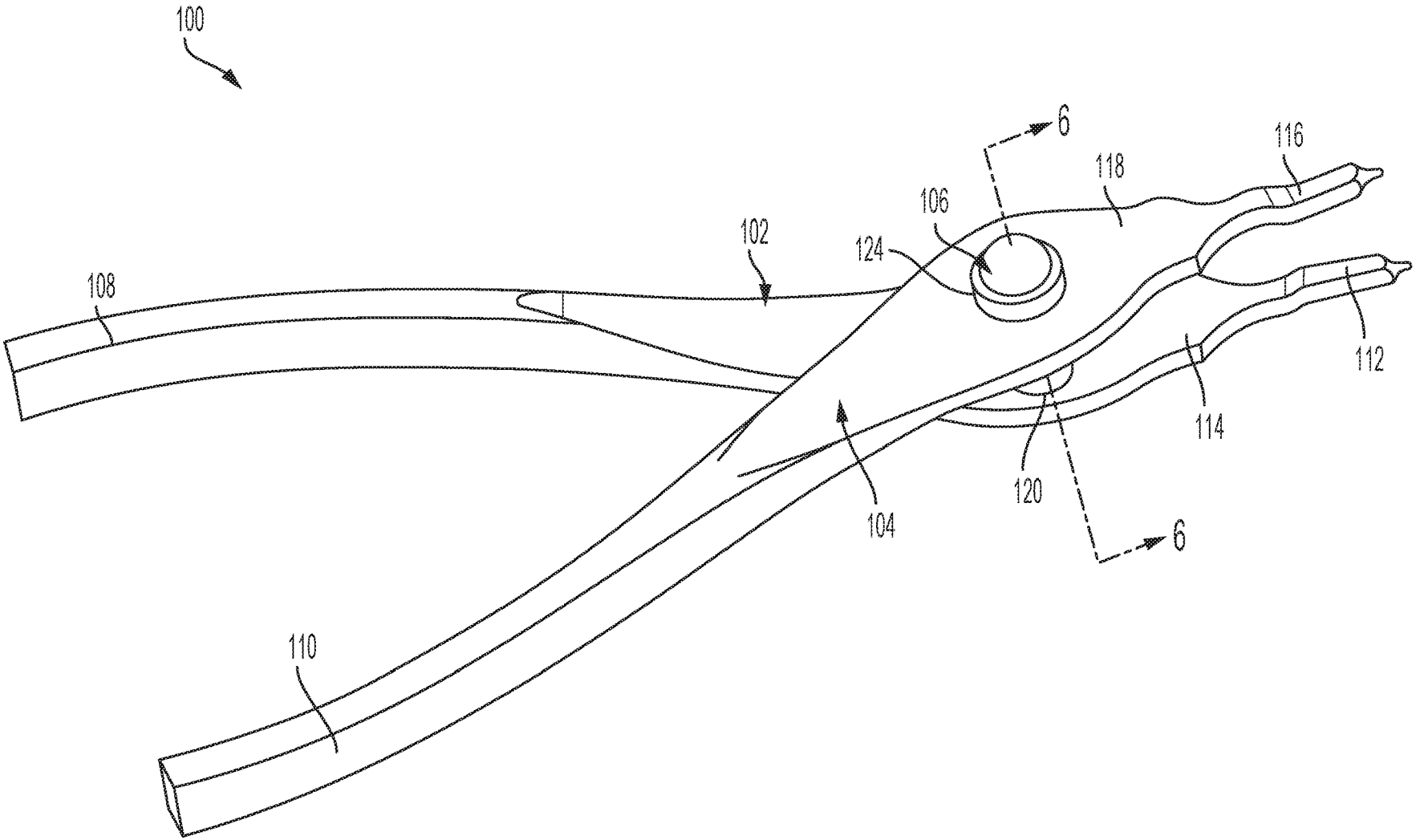
FIG. 1 is a front perspective view of pliers according to an embodiment of the present invention.
Figure 2:
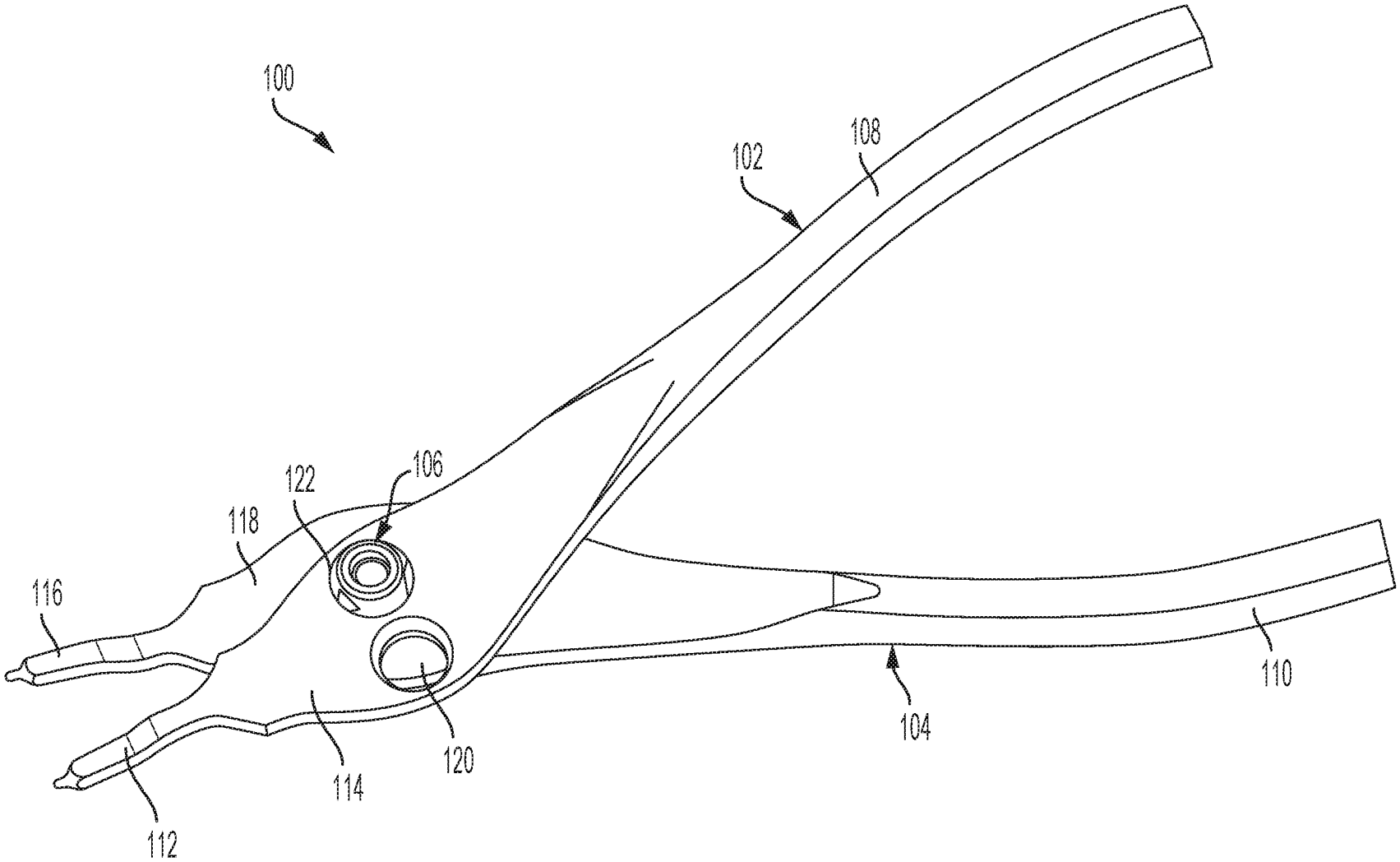
FIG. 2 is a back perspective view of pliers according to an embodiment of the present invention.
Figure 3:
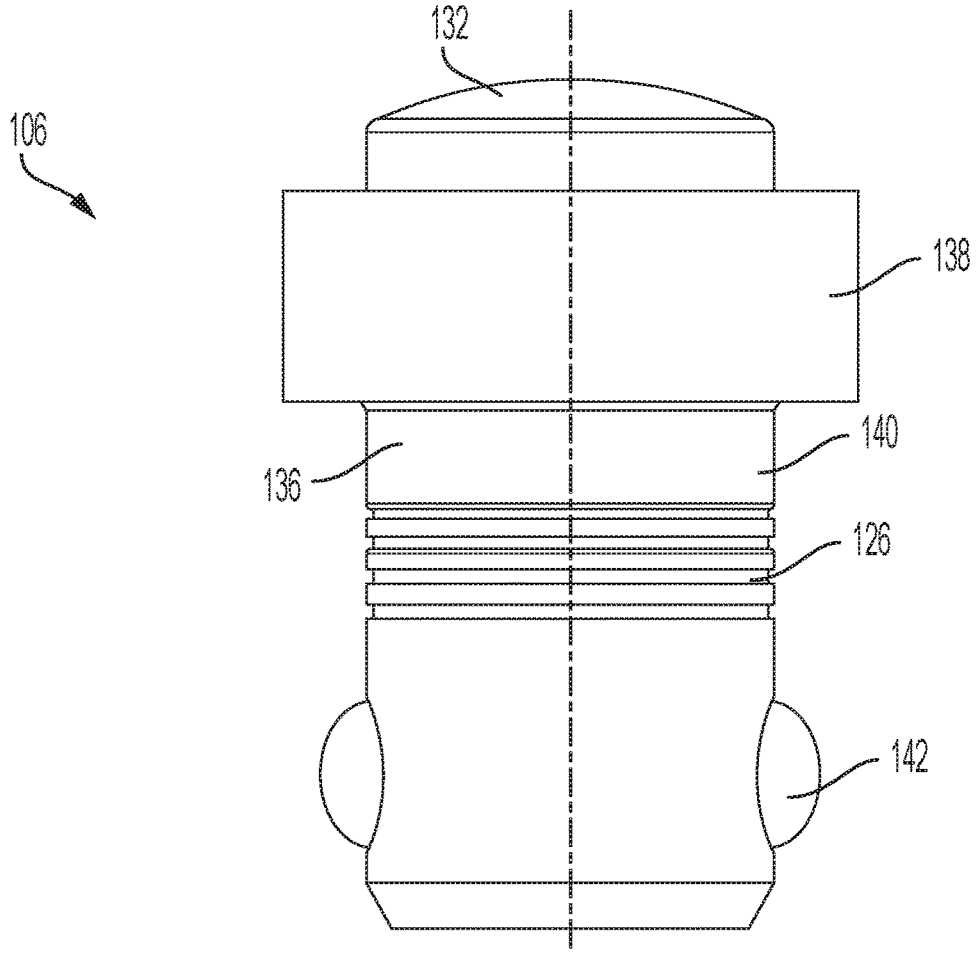
FIG. 3 is a side plan view of a push button release mechanism according to an embodiment of the present invention.

While this invention is susceptible of embodiments in many different forms, there is shown in the drawings, and will herein be described in detail, a preferred embodiment of the invention with the understanding that the present disclosure is to be considered as an exemplification of the principles of the invention and is not intended to limit the broad aspect of the invention to embodiments illustrated. As used herein, the term "present invention" is not intended to limit the scope of the claimed invention and is instead a term used to discuss exemplary embodiments of the invention for explanatory purposes only.

The present invention broadly comprises a push button release mechanism for pivotally coupling together two portions of a tool, such as, for example, pliers. The push button release mechanism includes external threads adapted to threadably couple to internal threads of one of the portions. The push button release mechanism can include one or more detent balls that are pushed in a radially-outward direction to pivotally couple the two portions of the tool together. A push button head can be pressed axially and cause the balls to descend into the interior of the push button release mechanism, thereby allowing the two portions of the tool to be separated.

Referring to FIGS. 1-8, a tool 100, such as, for example, pliers, includes a first portion 102 and a second portion 104 pivotally coupled together with a push button release mechanism 106. The first portion 102 includes a first handle 108 opposite a first jaw 112 and a first base 114 disposed between the first handle 108 and the first jaw 112. The second portion 104 includes a second handle 110 located opposite a second jaw 116 and a second base 118 disposed between the second handle 110 and the second jaw 116. The push button release mechanism 106 is adapted to pivotally couple the first 102 and second 104 portions together at the first 114 and second 118 bases.

The first portion 102 includes first 120 and second 122 openings adapted to axially receive the push button release mechanism 106, so the first portion 102 is rotatable about push button release mechanism 106. For example, the first 120 and second 122 openings are located in the first base 114 and have a substantially circular cross-section. In this manner, the first 102 and second 104 portions can be removably coupled together in one of at least two configurations to allow a wider or narrower distance between the first 112 and second 116 jaws, depending on the application of the tool 10 by the user. For example, the narrower distance is desirable for the installation/removal of an internal snap ring, and the wider distance is desirable for installation/removal of an external snap ring.

Figure 4:
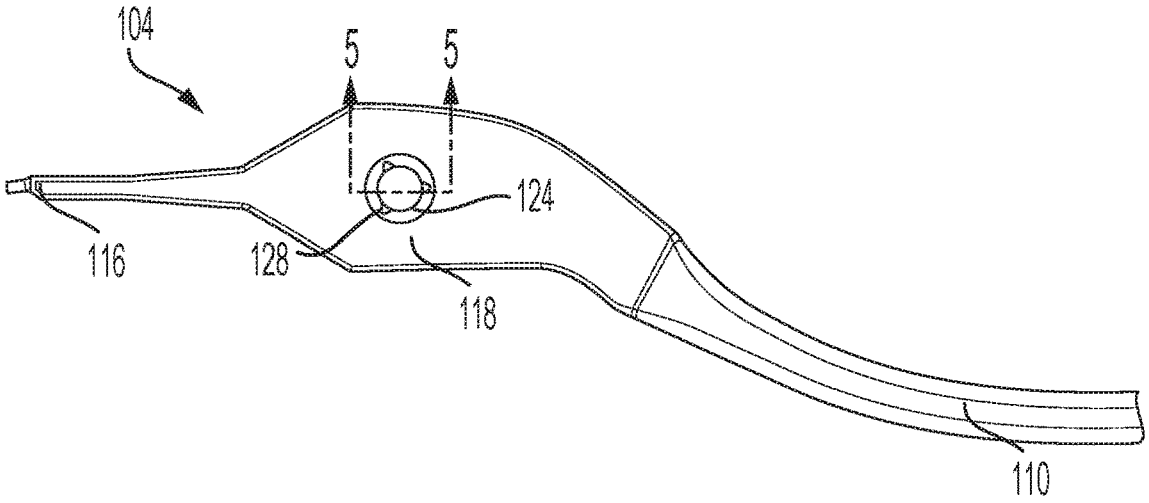
FIG. 4 is a plan view of a pliers' portion according to an embodiment of the present invention.
Figure 5:
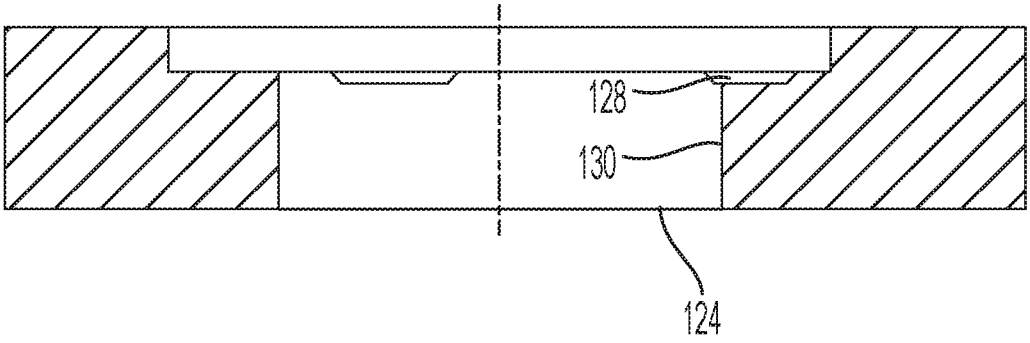
FIG. 5 is a sectional view of a pliers' portion taken along line 5-5 of FIG. 4.
Figure 6:
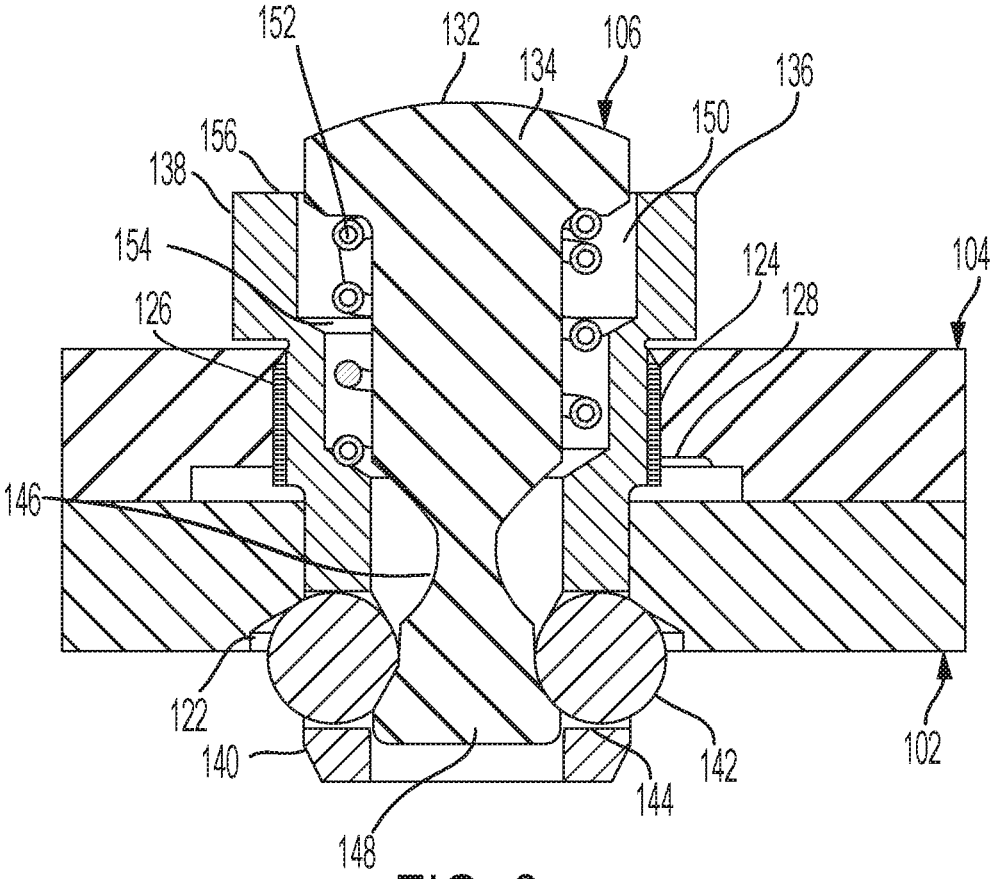
FIG. 6 is a sectional view of the pliers of FIG. 1 taken along line 6-6 of FIG. 1.
Figure 7:
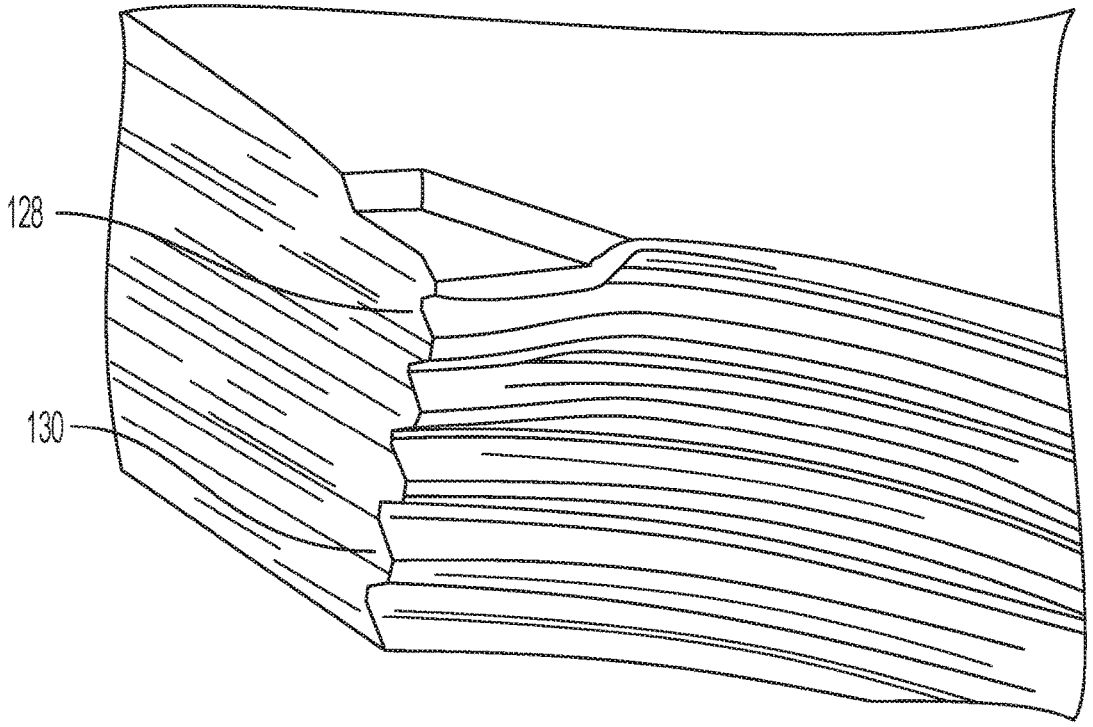
FIG. 7 is an enlarged partial perspective view of a threaded opening of a pliers' portion according to an embodiment of the present invention.
Figure 8:
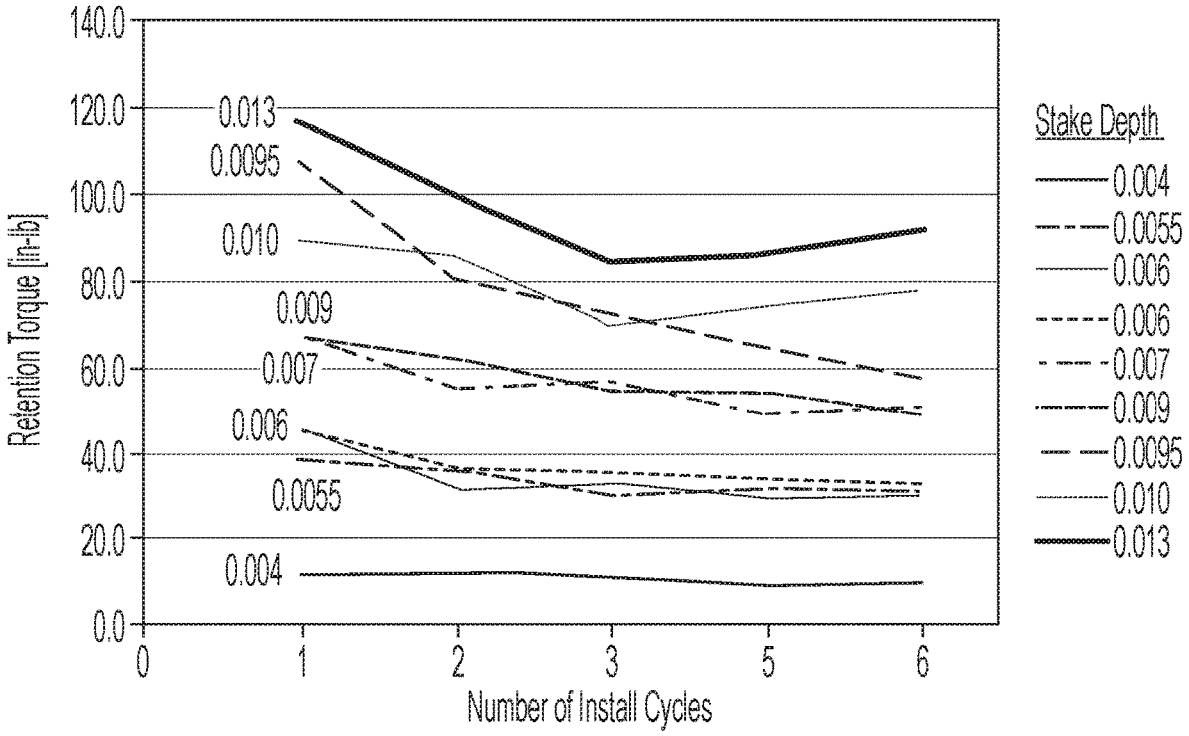
FIG. 8 illustrates a graph of retention torque measurement according to an embodiment of the present invention.

The second portion 104 can include a threaded opening 124 that threadably couples to external threads 126 formed on the push button release mechanism 106. Accordingly, the push button release mechanism 106 can be rotated in a clockwise and counterclockwise directions to change its position relative to the second portion 104 due to the threadable coupling. The threaded opening 124 is disposed in the second base 118. As illustrated in FIGS. 6 and 7, the threaded opening 124 can include a deformed portion 128 and an undeformed portion 130. The deformed portion 128 can be formed, for example, by staking. The shape of the deformed portion 128 can vary from those shown and can be chosen such that the push button release mechanism 106 can be adjusted a number of times without degrading the performance. The depth of the deformed portion can be in a range of about 0.004-0.013 inches. FIG. 8 illustrates a graph of example prevailing torque measurements at various depths between 0.004-0.013 inches and install cycles. As best illustrated in FIG. 4, the threaded opening 124 has three deformed portions 128, although the invention is not limited to three deformed portions and any suitable number of deformed portions can be used. The deformed threads of the deformed portion 128 act like springs to apply a large amount of pre-load axial force to the external threads 126 of the push button release mechanism 106, thereby causing the retention torque (also referred to as prevailing torque) required to rotate the push button release mechanism 106 to change its position relative to the second portion 104 to increase. In an embodiment, the resulting retention torque exceeds loads that would normally be applied by the user's hand (i.e., without the use of an adjustment tool, such as a wrench) to rotate the push button release mechanism 106, which would normally cause the push button release mechanism 106 to move relative to the second portion 104, which would cause the threaded connection to unintentionally disengage.

The push button release mechanism 106 can include a push button 132 having a head 134 and is axially movable between first and second positions within a sleeve 136. The sleeve 136 can include a collar 138 for receiving the head 134 and a stem 140 that houses internal components of the push button release mechanism 106 and has the external threads 126 formed thereon. One or more detent balls 142 can be disposed within the stem 140 and can be biased radially outward by the push button 132, as discussed below. The balls 142 and the collar 138 provide structure for pivotally coupling and retaining the first portion to the second portion 104 and the push button release mechanism 106 together. The second portion 104 is threadably coupled to the push button release mechanism 106, and the detent balls 142 retain the first portion to the second portion 104 and the push button release mechanism 106. Accordingly, the first portion 102 is adapted to rotate about and pivot on the axially received push button release mechanism 106, thereby allowing the first portion 102 to be rotated relative to the second portion 104 and the push button release mechanism 106. For example, the two portions 102, 104 of the pliers can be sandwiched between the balls 142 and the collar 138 about the push button release mechanism 106 in an axial direction. In particular, and by way of example only, the collar 138 can have an outer diameter larger than an outer diameter of the stem 140, and the balls 142 can extend beyond the outer diameter of the stem 140 when substantially aligned with the engagement portion 148. In an embodiment, the collar 138 can have a substantially circular cross-section. In another embodiment (not shown), the collar 138 can have a cross-section adapted to engage an adjustment tool, such as, for example, a wrench, to assist in overcoming the retention torque to adjust the position of the push button release mechanism 106. In this embodiment, the cross-section can have a hexagonal, square, or other suitable shape.

The sleeve 140 includes one or more ball openings 144, that the balls 142 are respectively disposed within. The push button 132 includes a receiving portion 146 having a first diameter, and an engagement portion 148 having a second diameter and extending axially from the receiving portion 146. The first diameter can be less than the second diameter to allow the balls 142 to descend within the ball openings 144 towards the receiving portion 145 when the push button 132 is depressed axially inward into the sleeve 136.

The sleeve 136 can include a cavity 150 adapted to receive the push button 132. A biasing member 152, such as, for example, a spring, can rest on a shoulder 154 that extends circumferentially within the cavity 152 and is adapted to elastically bias the push button 132 outward from the shoulder 154 to a first position. In the first position, the engagement portion 148 abuts the balls 142, as illustrated in FIG. 6. The shoulder 154 can be angled axially and radially to form a chamfer within the cavity 150. The shoulder 154 provides the necessary support for the biasing member 152 to bias against the head 134 of the push button 132.

The head 134 can be any structure or size that allows a user to push against the push button 132 and cause the push button 132 to move axially inward relative to the cavity 150. The head 134 can have a lower surface that, when in the first position, is located axially lower (i.e., closer to the balls 142 in the axial direction) than a leading edge 156 of the collar 138. In this manner, the collar 138 can provide structural support for the head 132 in the radial direction and reduce the likelihood of the head 132 being released from the cavity 150.

The balls 142 can be any size, but are typically larger than the ball openings 144 in which they sit to prevent the balls 142 from passing completely through the ball openings 144. In the first position, the balls 142 are pushed in a radially outward direction by the force of the engagement portion 148 pushing against the balls 142. In the second position when the head 132 is pushed axially inward, the balls 142 descend within the stem 140 and abut the receiving portion 146. The balls 142 are sized to descend within the stem 140 such that the balls do not substantially extend radially outside of the outer diameter of the stem 140.

During use, when a user wishes to separate the first 102 and second 104 portions, the user can push downwardly on the head 132 to push the push button 132 inwardly into the cavity 150. In so doing, the receiving portion 146 is aligned with the balls 142 and allows the balls 142 to descend radially inward to the stem 140 and abut against the receiving portion 146. This allows the balls 142 to clear the outer diameter of the stem 140 to allow the stem 140 to be removed from the first portion 102. When the user wishes to pivotally couple the first 102 and second 104 portions, the user inserts the push button retention mechanism into a preferred orientation of one of the first 120 and second 122 openings. The user can then push downwardly on the head 134 again and reverse the above operation.

As shown, the balls 142 can be two balls that are both pushed in a radially-outward direction. However, the balls 142 need not be two in number and can be any number, including a single ball, without departing from the spirit and scope of the present invention.

As shown, the tool 100 can be snap ring pliers with jaws 116, 118 suitable for snap ring installation/removal. However, the tool 100 can be any other type of pliers, for example needle nose pliers, slip joint pliers, channel locks, hose clamp pliers, diagonal pliers, or crimping pliers. Further, the tool 100 need not be pliers at all and can be a cutting tool or other multi-handle tool with rotatable halves.

By utilizing a threaded connection, alignment of the push button release mechanism 106 relative to the second portion 104 can be controlled and accurately set on an individual assembly basis, thereby eliminating issues arising from the variation in manufacturing tolerances. Therefore, when the first and second portions are pivotally coupled together, there is less "play" between the two portions. The thread deformation provides enough retention to prevent unintended disengagement of the push button release mechanism 106 from the second portion 104, or change of its position relative to the second portion 104, potentially causing issues. The thread deformation is such that the push button release mechanism 106 can be adjusted a number of times without degrading the performance. Accordingly, the disclosed invention provides a finely adjustable and secure connection between the push button release mechanism 106 and the second portion 104.

As used herein, the term "coupled" and its functional equivalents are not intended to necessarily be limited to direct, mechanical coupling of two or more components. Instead, the term "coupled" and its functional equivalents are intended to mean any direct or indirect mechanical, electrical, or chemical connection between two or more objects, features, work pieces, and/or environmental matter. "Coupled" is also intended to mean, in some examples, one object being integral with another object.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of the inventors' contribution. The actual scope of the protection sought is intended to be defined in the following claims when viewed in their proper perspective based on the prior art.

What is claimed is:

1. A tool comprising:

first and second portions pivotally coupled together by a push button release mechanism, wherein the first portion includes a first opening adapted to axially and slidably receive the push button release mechanism, and the second portion includes a threaded opening threadably coupled to the push button release mechanism, and wherein the push button release mechanism includes:

a push button axially movable between first and second positions and including a receiving portion and an engagement portion extending axially from the receiving portion;

a sleeve defining a cavity within which the push button moves axially, the sleeve including external threads and a ball opening, wherein the external threads are threadably coupled to the threaded opening and at least a portion of the threaded opening includes deformed threads;

a ball disposed within the ball opening; and a biasing member adapted to bias the push button axially outward from the cavity to the first position and substantially align the engagement portion with the ball when axial force is not applied to the push button, wherein when axial force is applied to the push button, the push button is adapted to be disposed in the second position to align the receiving portion with the ball.

2. The tool of claim 1, wherein the engagement portion includes an engagement portion outer diameter that is greater than a receiving portion outer diameter of the receiving portion.

3. The tool of claim 1, further comprising a shoulder disposed within the cavity and extending axially and radially within the cavity, the shoulder is adapted to provide support for the biasing member.

4. The tool of claim 1, wherein the push button includes a head that integrally includes the receiving portion and the engagement portion.

5. The tool of claim 1, wherein the deformed threads are formed by staking.

6. The tool of claim 1, wherein a depth of the deformed threads is between about 0.004-0.013 inches.

7. The tool of claim 1, further comprising a second ball disposed within a second ball opening disposed in the sleeve.

8. The tool of claim 1, wherein the ball and the receiving portion are sized to allow the ball to move into the ball opening and abut the receiving portion, such that the ball is substantially radially internal to an outer diameter of the sleeve when the push button is in the second position.

9. The tool of claim 1, wherein the push button includes a lower surface and the sleeve includes a collar that includes a leading edge, and wherein the lower surface is located axially internal to the cavity compared to the leading edge.

10. The tool of claim 9, wherein the collar has a cross-section adapted to engage an adjustment tool.

11. The tool of claim 1, wherein the first portion includes a second opening adapted to receive the push button release mechanism.

12. The tool of claim 1, wherein the biasing member is a spring.

13. A push button release mechanism adapted to selectively and rotatably couple first and second portions of a tool, the push button release mechanism comprising:

a push button axially movable between first and second positions and including a receiving portion and an engagement portion extending axially from the receiving portion;

a sleeve defining a cavity within which the push button moves axially, the sleeve including a ball opening and external threads adapted to threadably couple to a threaded opening in the second portion, wherein at least a portion of the threaded opening includes deformed threads that apply an axial force to the external threads when the external threads are threadably coupled to the threaded opening;

a ball disposed within the ball opening; and a biasing member adapted to bias the push button axially outward from the cavity to the first position and substantially align the engagement portion with the ball when axial force is not applied to the push button, wherein when axial force is applied to the push button, the push button is adapted to be disposed in the second position to align the receiving portion with the ball.

14. The push button release mechanism of claim 13, wherein the engagement portion includes an engagement portion outer diameter that is greater than a receiving portion outer diameter of the receiving portion.

15. The push button release mechanism of claim 13, further comprising a second ball disposed within a second ball opening disposed in the sleeve.

16. The push button release mechanism of claim 13, wherein the ball and the receiving portion are sized to allow the ball to move into the ball opening and abut the receiving portion, such that the ball is substantially radially internal to an outer diameter of the sleeve when the push button is in the second position.

17. The push button release mechanism of claim 13, wherein a ball outer diameter of the ball is greater than a diameter of the ball opening.

18. The push button release mechanism of claim 13, wherein the sleeve includes a collar that is shaped to engage an adjustment tool.

* * * * *